US005807425A

United States Patent [19]

Gibbs

[11] Patent Number: 5,807,425

[45] Date of Patent: Sep. 15, 1998

[54] ELECTROFILTER

[76] Inventor: Robert William Gibbs, 192 George St., Belleville Ontario, Canada, K8N 3H2

[21] Appl. No.: 581,546

[22] PCT Filed: Jul. 13, 1994

[86] PCT No.: PCT/GB94/01520

§ 371 Date: Apr. 19, 1996

§ 102(e) Date: Apr. 19, 1996

[87] PCT Pub. No.: WO95/02460

PCT Pub. Date: Jan. 26, 1995

[30] Foreign Application Priority Data

Jul. 17, 1993 [GB] United Kingdom ..... 9314950

[51] Int. Cl.[6] ..... B03C 3/155

[52] U.S. Cl. ..... 96/66; 96/96; 96/99

[58] Field of Search ..... 96/66–69, 63, 96/96, 99, 65, 95; 422/120; 95/78; 55/481, 493, DIG. 5

[56] References Cited

U.S. PATENT DOCUMENTS

| | | | |
|---|---|---|---|
| 3,053,028 | 9/1962 | Kayko | 96/17 |
| 3,735,560 | 5/1973 | Wellman | 55/481 X |
| 4,549,887 | 10/1985 | Joannou | 55/493 X |
| 4,588,537 | 5/1986 | Klaase et al. | 55/DIG. 5 |
| 4,828,586 | 5/1989 | Joannou | 96/66 |
| 5,035,728 | 7/1991 | Fang | 422/120 X |
| 5,059,218 | 10/1991 | Pick | 96/66 |
| 5,108,470 | 4/1992 | Pick | 96/66 X |
| 5,330,559 | 7/1994 | Cheney et al. | 96/66 X |
| 5,336,299 | 8/1994 | Savell | 95/78 X |

FOREIGN PATENT DOCUMENTS

| | | | |
|---|---|---|---|
| 0 292 036 A2 | 11/1988 | European Pat. Off. . | |
| 0 337 017 A1 | 10/1989 | European Pat. Off. . | |
| 55-24561 | 2/1980 | Japan | 96/66 |
| 2 265 556 | 10/1993 | United Kingdom . | |

*Primary Examiner*—Richard L. Chiesa

*Attorney, Agent, or Firm*—Zarley, McKee, Thomte, Voorhees & Sease

[57] ABSTRACT

A filter apparatus of the present invention includes a filter housing having an inlet and an outlet and a filter device locatable therebetween. The filter device includes a filter medium, an electrically conductive screen or mesh, and a conductor for supplying high voltage power. The conductor abuts the filter medium such that when the conductor is subject to a high voltage, the filter medium is polarized and nothing, apart from air or a support or retention material of dielectric material, is on a side of the filter medium immediately opposite to the conductor and no other charge applying device is located upstream of the conductor.

14 Claims, 8 Drawing Sheets

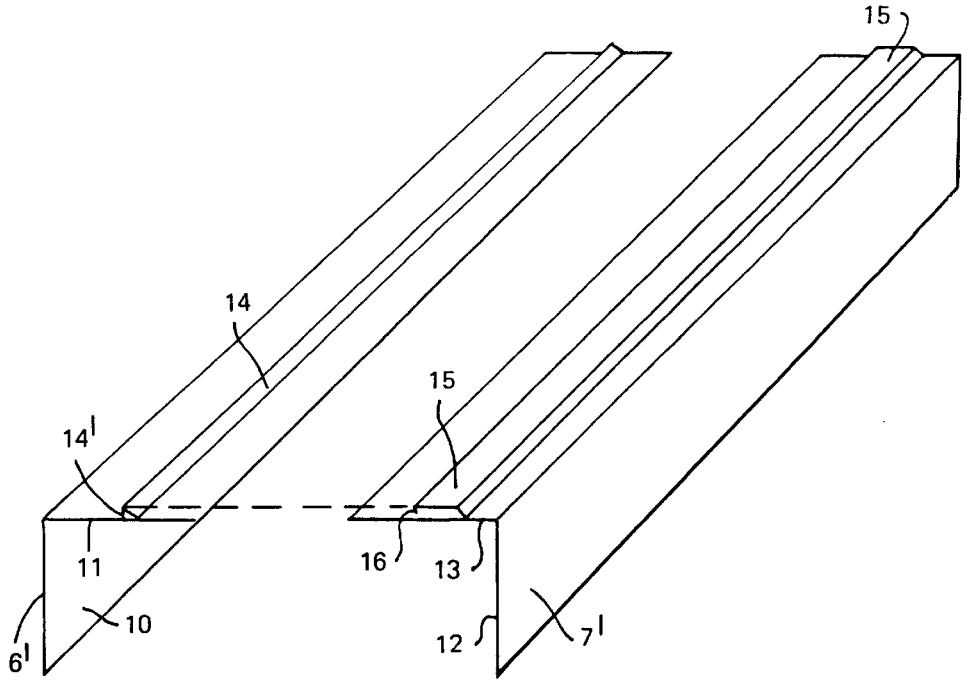
FIG. 6
FIG. 6a
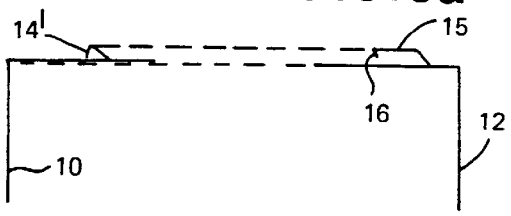
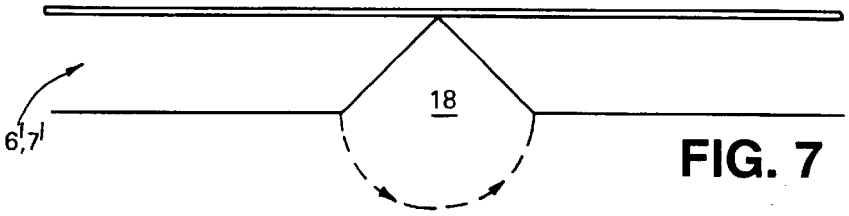
FIG. 7
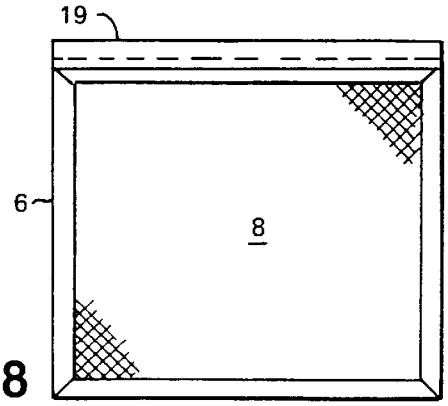
FIG. 8
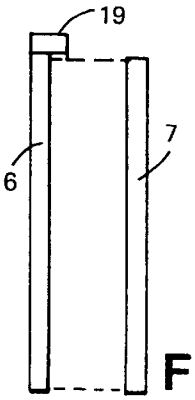
FIG. 8a

ELECTROFILTER

BACKGROUND OF THE INVENTION

The present invention relates to a filter device for removing particles from gas such as from air.

There is an ever increasing awareness of the need to remove undesirable particles, such as resulting from the smoking of tobacco, from the air in public places, such as offices and from domestic environments and it is an object of the present invention to provide an improved means for enabling such particle removal.

Simple mechanical filters are known but, unless they are of a particularly expensive type, such are not sufficiently efficient for the intended purpose and soon become clogged. In prior, known devices it is possible to remove and discard the contaminated filter media although the support frame which forms part of the filter device is also often contaminated—especially by tobacco smoke—and retains foul odours, such frame is not readily cleaned because all its components were permanently attached, usually by some form of hinge. Thus even after replacement of the filter media, foul odours of such prior devices are still apparent on the framing and are subsequently emitted.

It is also known that particles are removed by ionisers which produce negatively charged ions which combine with other airborne particles in the air and are then attracted to walls and other surfaces inside and outside of the device. Electro static precipitators are also known which include a duct containing charge applying means which uses a high voltage corona discharge which charges airborne particles and then downstream thereof with respect to the flow of air, a plurality of electrically conductive metal baffle plates, which may be oppositely charged attract the charged particles (e.g. of 0.30 micron) which adhere thereto and to the subsequent downstream walls. Such devices are not particularly efficient and require very high DC potential which is also particularly expensive to produce and also produces ozone which can be dangerous to health and some such devices are banned in USA and Canada.

Electro-static filters are also known wherein a fan passes air through a filter material and such mechanical frictional action causes the filter material to be electrostatically charged so as to draw particles to such although such devices have a limited efficiency. EP-A-0292036 discloses an electrostatic air filtration system having an electrically conductive screen sandwiched between first and second dielectric fibrous filter pads which in turn are sandwiched between outer electrically conductive screens so as to thereby apply electrostatic charges to particles in the air passing therepast.

I recently discovered that when a high voltage field is applied to a very low efficiency filter medium of dielectric material and providing such is non-tackified, such will increase the capability of the filter medium to arrest particles many times beyond its original efficiency ratings. I accordingly proposed a filter device comprising a filter medium for gas of dielectric material, a charge applying means of electrically conductive material connectable to a supply of high voltage power and juxtaposed said filter material such that when said electrically conductive material is subject to a high voltage a charge is applied to said dielectric material over its surface area, and an earth or ground means juxtaposed said filter medium on a side of said filter medium opposite to said charge applying means.

However, research and tests have shown that the feature of the ground means on a side of the filter medium opposite to the charge applying means and preferably at least the downstream side relative to the air flow, whilst initially increasing efficiency and minimising the discharge of particles which may become charged in the filter medium, does have a serious disadvantage when the filter has become laden with precipitate/deposits. It is found that the charge of the filter device drops as a consequence of current flowing through the laden filter medium to the ground means. This results in the efficiency of the filter device being reduced but, possibly more importantly, also causes the retained particles including gasses to be released which can be dangerous as the release can be sudden.

SUMMARY OF THE INVENTION

According to the present invention there is provided a filter device comprising a filter medium for gas with said medium being of polarisable dielectric material, a screen or mesh of electrically conductive material connectable to a supply of high voltage power and to abut or be adjacent said filter medium and support means of dielectric material for said screen or mesh and filter medium such that when said electrically conductive material is subject to a high voltage, the material of the filter medium is polarised; there being either nothing apart from air or a support or retention means of dielectric material on a side of said filter medium immediately opposite to said potential means.

Whilst reference is made herein to a screen or mesh there is intended to be covered any (one or more) metal gauze or wire mesh or perforated metal sheet or foil or like or any grill-like or other disposition of wires, or any conductive means (potential distribution means) which is of an area to sufficiently polarise the filter medium. Preferably two filter media will be provided each located on opposite sides of said charge applying means and preferably two dielectric retention or support means will be provided located at distal opposite sides of the two filter media with said support means preferably in the form of a mesh of electrically non-conductive material.

In a preferred embodiment according to the invention a filter device comprises two sheets of filter medium for gas and of dielectric and polarisable material located either side of a potential means in the form of an electrically conductive screen, mesh or the like; two support means in the form of electrically non-conductive material sheets, such as a plastics material mesh, perforated screen or other filament-like or the like arrangement, located at opposite distal surfaces of said filter sheets with the thus provided laminate arrangement being connectable together.

It has thus now been discovered that a filter device without ground means works satisfactorily even when laden with deposits.

The outer support means each preferably have a peripheral frame forming a support or housing part for the composite arrangement. Preferably a high voltage power supply or means for supplying a high voltage to said potential means e.g. a voltage multiplier device, will be mounted on the frames forming support means.

The filter medium is of dielectric and polarisable material and preferably is a known filter material in sheet form preferably a non-woven random disposition mat preferably of glass fibres possibly bonded with urea formaldehyde or other, or may be polypropylene, polystyrene or nylon and may be non tackified. It has been found particularly advantageous to use an open weave filter medium preferably of polyester or polystyrene which may be polarised.

In a preferred filter device preferably automatic earthing or ground means will be provided and operable such that upon separation of the components, the potential means is grounded for safety purposes.

In preferred embodiments of the invention, all components are detachable so that each can be removed from the other and may be immersed in a cleaning solution for the purpose of removing any film which may emit a foul odour.

It is to be appreciated that in the present invention the filter medium is polarised and a high voltage charge is not applied to the airborne particulate upstream of the filter medium nor upstream of the potential means (screen or mesh) adjacent or abutting the filter medium. It is to be appreciated that the screen or mesh supported by a frame of dielectric material is electrically insulated from any of the electrically conductive components of a supporting housing. To locate the screen or mesh between outer dielectric support frames, locating members may be provided at its corners to provide a snug fit within outer frames. Preferably the high voltage supply to the screen or mesh is disconnected automatically when any outer support frame is removed.

BRIEF DESCRIPTION OF THE DRAWINGS

The invention will be described further, by way of example, with reference to the accompanying drawings, in which:

FIGS. 6 and 6A comprise a schematic perspective view of two portions of the frames 6 and 7 prior to interconnection and FIG. 6A is an end elevation illustrating the snap fit interconnection also;

FIG. 7 illustrates two portions of a frame and the formation of a notch or cut-out portion to form a mitred corner—four such mitres being provided in one frame;

FIGS. 8 and 8A comprise an elevation of one frame member having a detachable device for providing high voltage supply with FIG. 8A being an edge elevation showing the two frames;

DETAILED DESCRIPTION OF THE PREFERRED EMBODIMENT

Figure 1:
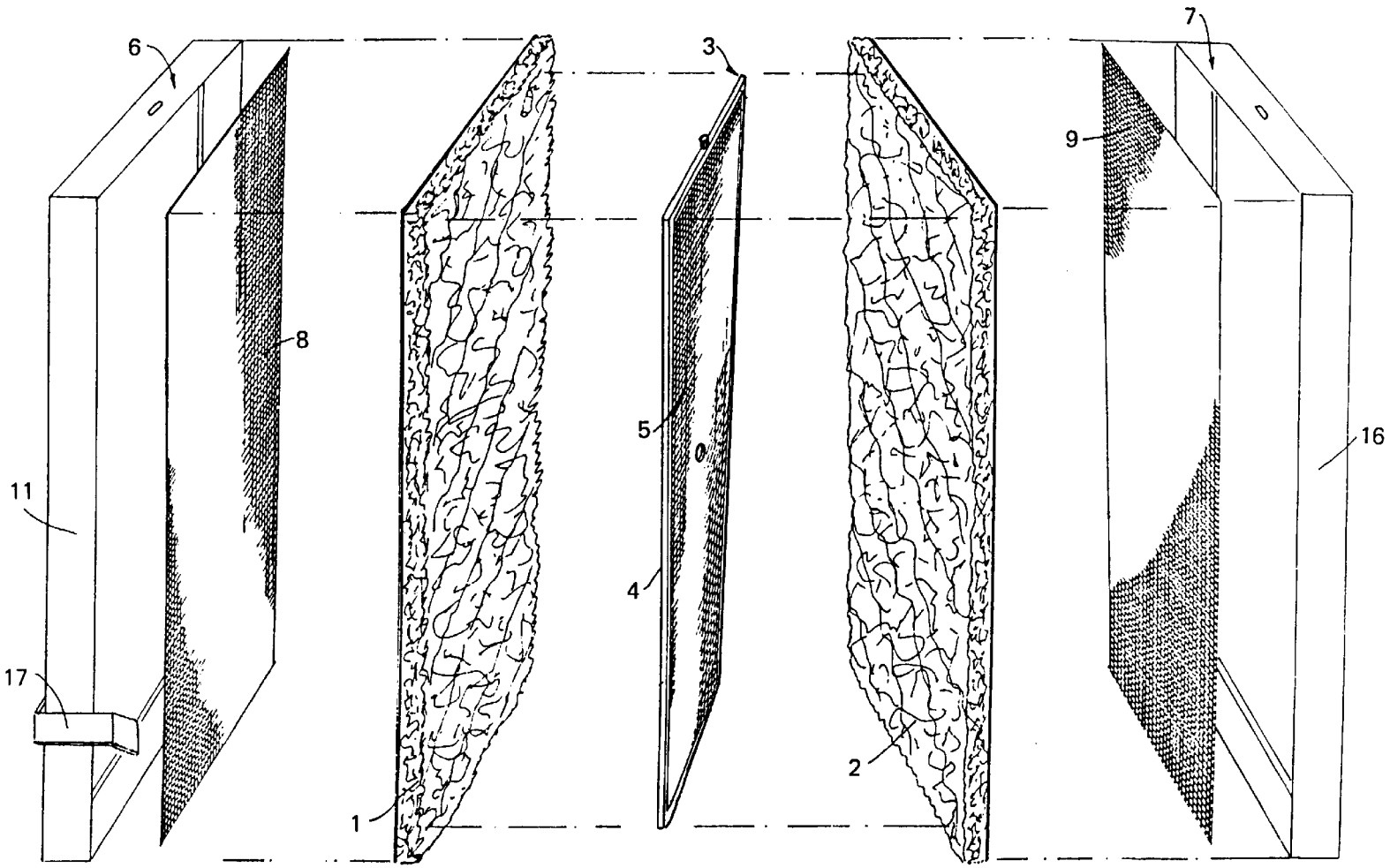
FIG. 1 is an exploded perspective view of a filter device forming a preferred embodiment according to the invention and comprising two outer supporting frames, two open weave support screens of dielectric material, two sheets of dielectric and polarisable filter material and a conductive central screen therebetween.

A filter device for filtering gas and preferably air is illustrated in FIGS. 1 to 5 and comprises two sheets 1 and 2 of non-tackified filter material for gas and formed of a dielectric and polarisable material such as non-woven matting of glass fibres or other fibres and being of the same rectangular shape and size as each other. The filter material is preferably glass fibre matt 1" nominal thickness and 16 nominal grams/sq.ft with a 25% binder of modified urea formaldehyde such as sold by Superior Glass Fibers, Inc. of Bremen, Ohio, U.S.A. or may be of polypropylene, polystyrene or nylon in "open weave" form.

An electrically conductive means 3 of electrically conductive material is normally sandwiched between sheets 1 and 2 and comprises a rectangular metal frame of aluminium strips 4 folded over to clamp between the faces thereof the edges of a rectangular metal screen or wire mesh 5.

First and second support means are provided in the form of two rectangular frames 6 and 7 with two meshes or screens 8 and 9 all of dielectric material and provided to hold sheets 1, 2 and 3 together. No earth means are provided. The frame 6 and 7 are formed from side portions each of substantially L-shaped section and in use oppositely facing such that they may be interengaged and clipped together.

In FIGS. 6 and 6A two oppositely facing frame portions 6',7' are illustrated formed of walls 10, 11 and 12, 13 with walls 11 and 13 having snap fit interengaging means 14, 15 provided thereon and in the form of an inclined catch beading 14' along wall 11 and a resilient channel forming portion 15' with downwardly extending catch 16 engageable on the rear surface of 14'. Wall 11 may slide over the upper surface of wall 13 and enter the space between 15 and 13 until catch 16 engages behind 14' to hold the two frame portions again. Additional holding brackets 17 are provided on frame 6 and clampable around frame 7.

The frame 6 and 7 of non-conductive material, are extruded in one piece and then mitred and bent into any desirable size. In FIG. 7 the formation of a corner is achieved by forming an angled notch or cut-out 18 in portion 6', 7' and then folding the remaining flexible portion forming a hinge and forming the mitred right angled corner of a frame.

The two screens 8 and 9 are detachable non-conductive media holding screens of open weave so as to reduce or minimise any pressure drop. Their purpose is solely to stop filter media from being blown through the frame by the system fans. The screens 8, 9 may be dispensed with when a self-supporting filter media is used which will not come apart in use.

The support for the sheets 1, 2, 3, 8 and 9 is provided by the outer screens 6 and 7 which interfit as described and may be clipped together one inside the other securing each to the other. A high voltage electronic supply device 19 will not be permanently attached but rather clipped into place after the frames are assembled. Thus the high voltage supply device 19 is easily detachable when replacing media pads and/or submersing all the components in a cleaning fluid to remove any contamination which may have built up on their surfaces.

The device 19 is provided for high voltage supply and is detachably mountable on the top of the clamped together frame members 8, 9 by way of two depending side walls 19'19" which locate either side of the oppositely outer facing surfaces of the frames 6, 7. The top surfaces of frames 6, 7 have apertures 20, 21 therein which are alignable and through which there may then extend an electrode 22 of device 19 which contacts a receptacle on conductive means 3 when located in position in use. The device 19 has terminal connections 23 for detachable connection to a supply of electricity.

As mentioned, the high voltage is applied to the conductive means 3 which is located between and in contact with the non-conductive filter media sheets 1 and 2 and the effect thereupon is to shift the surface electrons of each strand of media to face the high voltage carrier means. If the high voltage applied is positive, all the negative electrons will move to the front of each strand of media and all the positive electrons will collect on the back side. It has been discovered through testing that once this electron shift occurs, the media is in fact polarised, resulting in an effect on airborne particles similar to the effect a magnet has on iron filings.

The normal operation of a filter media is to rely on the airborne particles impacting on their surfaces—to increase the efficiency of arrest, more fibres are added to form closer and denser weaves. As this is done, the resistance to wear and movement is greatly increased and ever larger fans are required to move the air through the media. In the present invention, however, the airborne particles passing through a very open weave media and, subject to polarisation, will be pulled from the air stream and held by the power of the electrostatic force field effect and will not be easily removed by air flow.

Various modifications are possible without departing from the scope of the present invention. For example, if the filter media become clogged or heavily laden, an alarm means may be provided and operate an alarm. For example, a voltage drop indicator may be provided to sense voltage drop and upon reaching a predetermined level, issues an audio and/or visual alarm. Alternatively, duct means may be provided extending across the device and include a whistle device which when the pressure difference increases to a certain level, will operate to activate the whistle and alert the owner to the need for changing or cleaning of the filter medium.

It is also envisaged that an anti-microbial mesh and/or coating may be provided on the filter medium or the medium may incorporate such.

FIGS. 11 to 17 illustrate various housings for the filter device.

Figure 3:
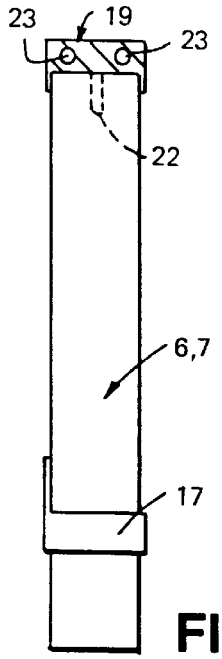
FIG. 3 is an end elevation of the two supporting frames of FIG. 1 and shown clipped together.
Figure 4:
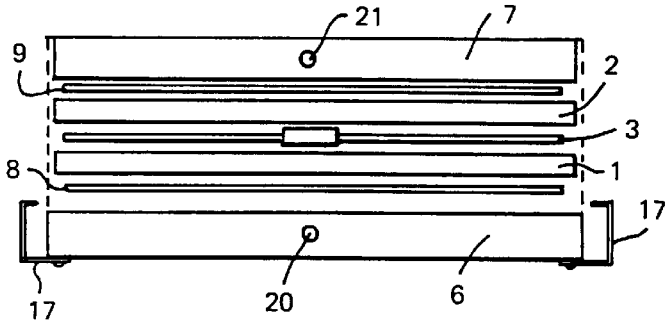
FIG. 4 is an exploded plan view of the filter device illustrating the location of holes through the support frame for a snap-on high voltage supply device.
Figure 5:
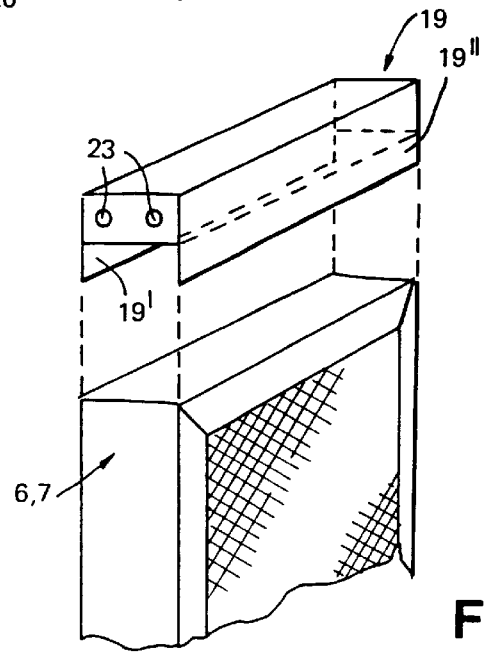
FIG. 5 is a fragmentary perspective view of the upper part of the filter device with the high voltage supply device detached and positioned thereabove.
Figure 9:
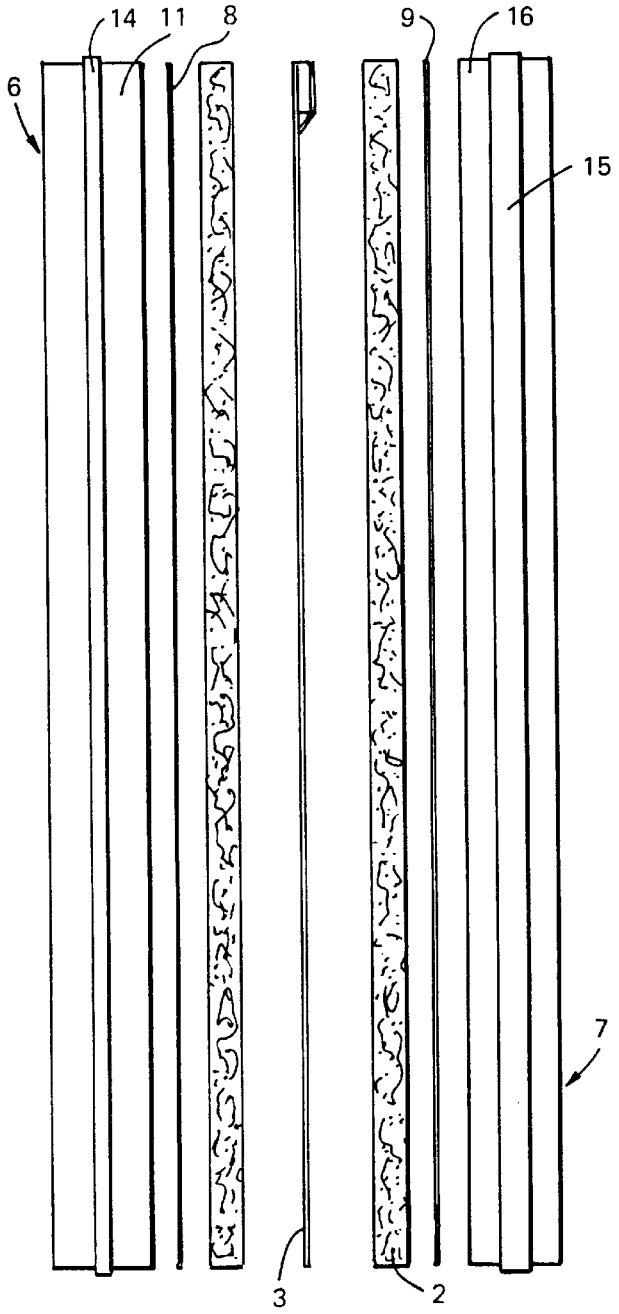
FIG. 9 is an end elevation of the filter device showing the components in exploded form.
Figure 10:
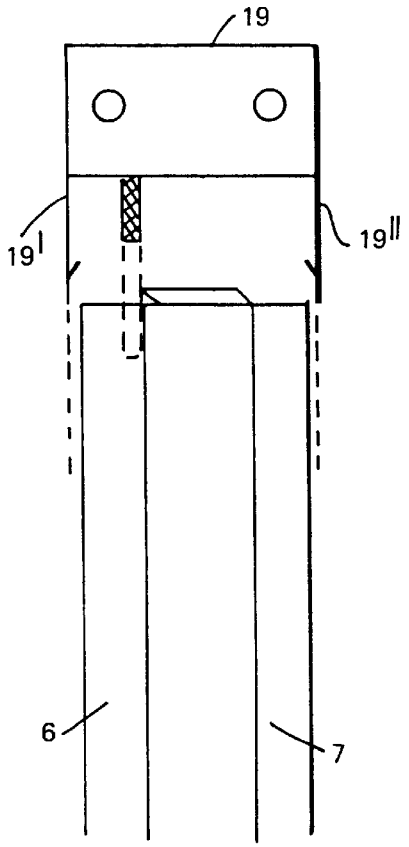
FIG. 10 is a fragmentary end elevation showing the high voltage supply device partly removed from the filter device and illustrating the electrode extending therefrom for contacting the charge applying means or sheet.
Figure 11:
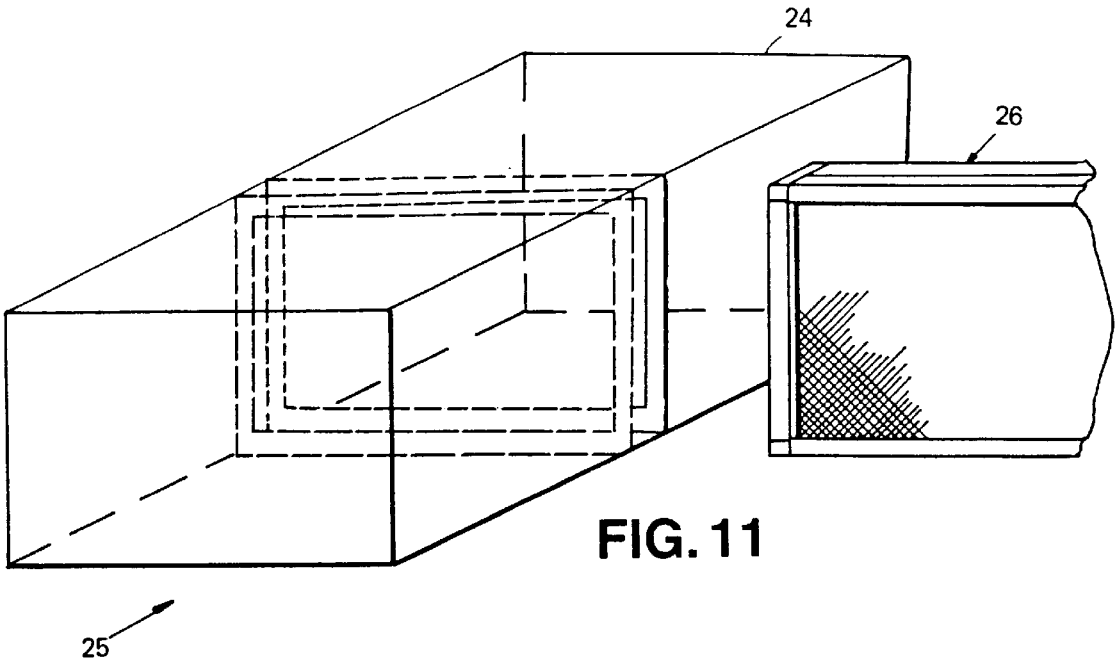
FIGS. 11–17 illustrate various housing arrangements for a filter device of the invention.

FIG. 11 is a schematic perspective view of a part of an air duct 24 with air flow 25 of a ventilation system. The duct 24 will previously have received a known filter device (not shown) which has been removed and is replaced by a filter device 26 according to the invention, for example, as shown in FIGS. 1 and 3, which is slid into the existing housing therefor.

Figure 12:
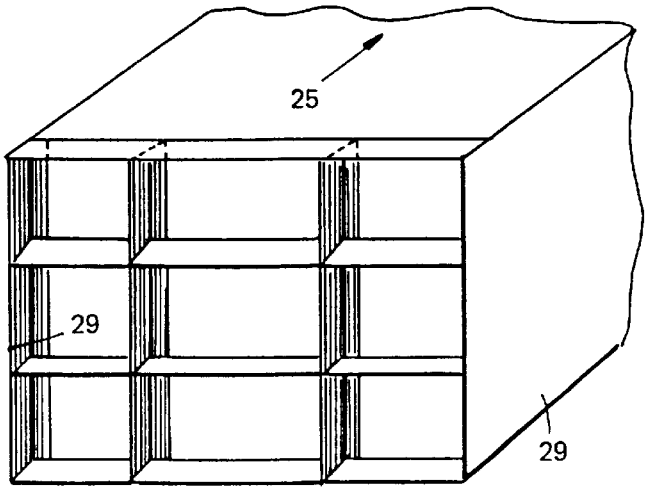

FIG. 12 is a perspective view of a very large air duct 27 of a ventilation system in which a filter housing is provided as a grid formation as is known and the filter device of the present invention will be sized to fit into the existing grid system 29 and into a new grid system.

Figure 2:
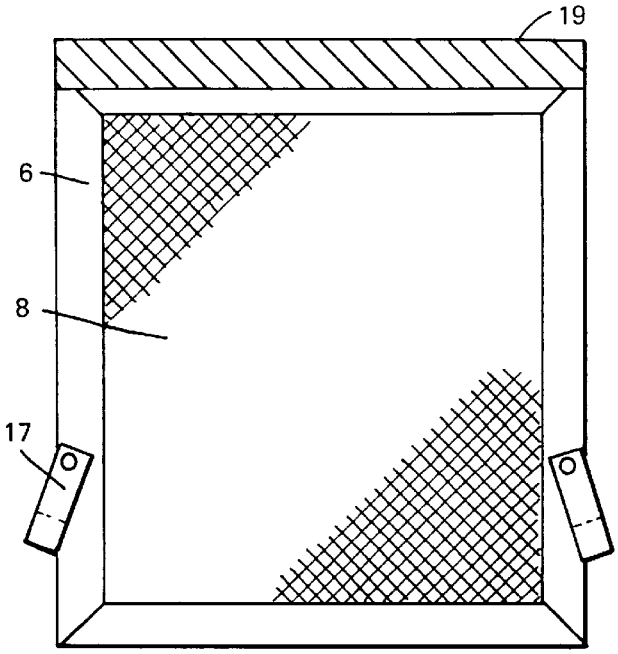
FIG. 2 is a side elevation of a support means or frame of dielectric material with retaining clips
Figure 13:
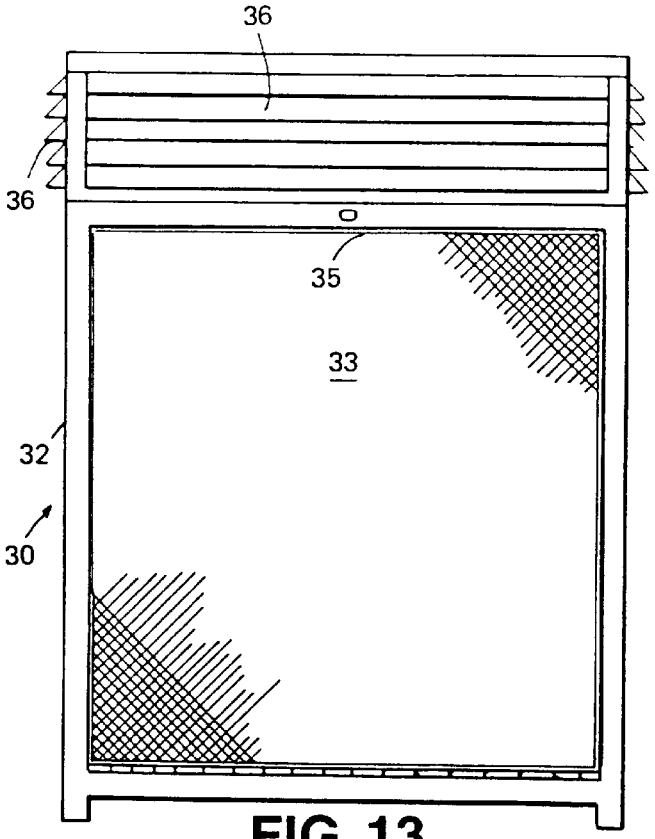
Figure 15:
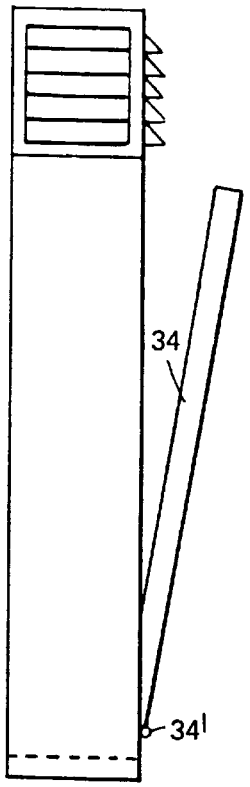
Figure 14:
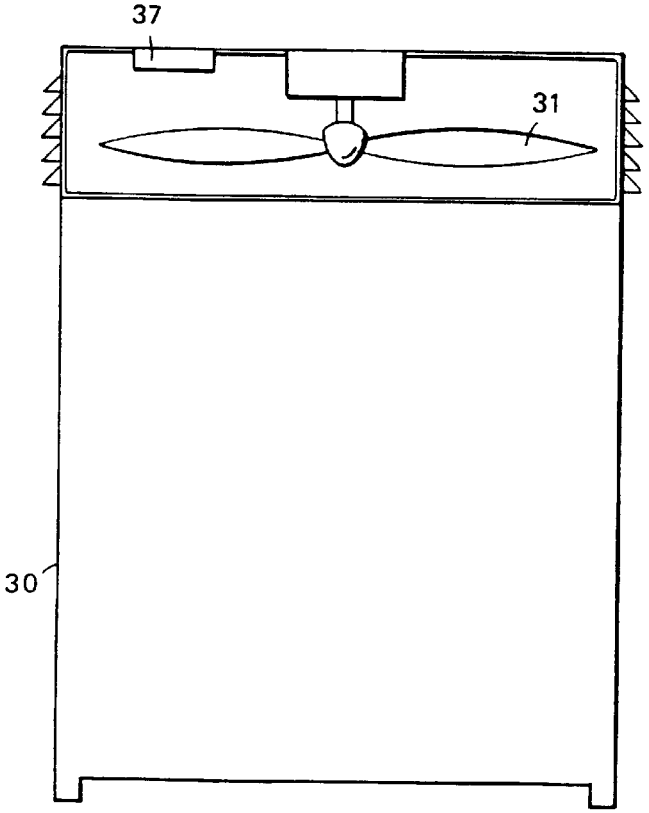

FIGS. 13 to 15 illustrate a unit 30 with a three speed electric fan 31 mounted within box-like housing 32. An air inlet 33 is provided at the front and an air filter device 34, for example, similar to that of FIGS. 1 to 3, is hingedly mounted at 34' and has a lock 35 and is removable for cleaning. Air outlets 36 in the form of louvres are provided at the top front and sides. The three speed electric fan 31 is provided with a 24 volt transformer 37 supply. The unit is for wall or floor support.

Figure 16:
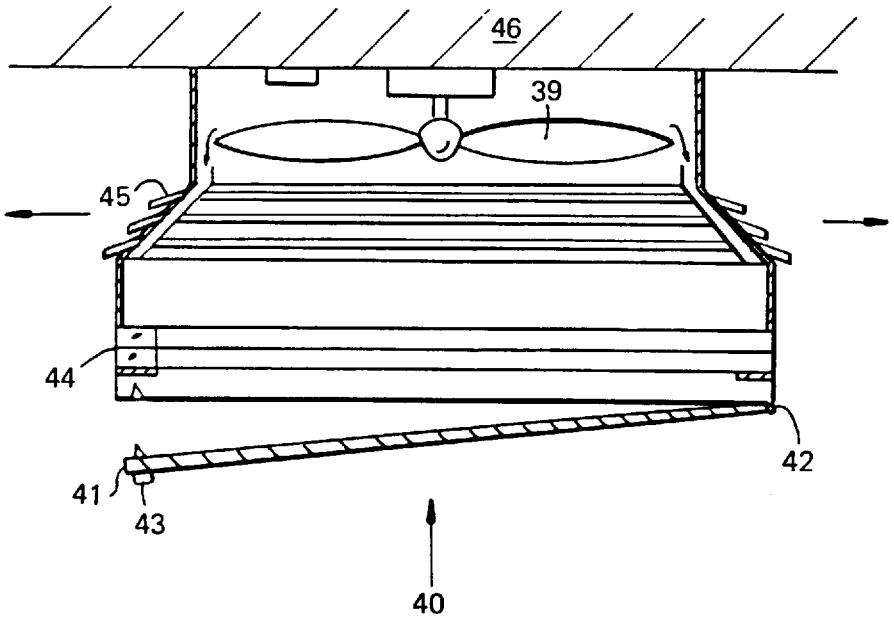
Figure 17:
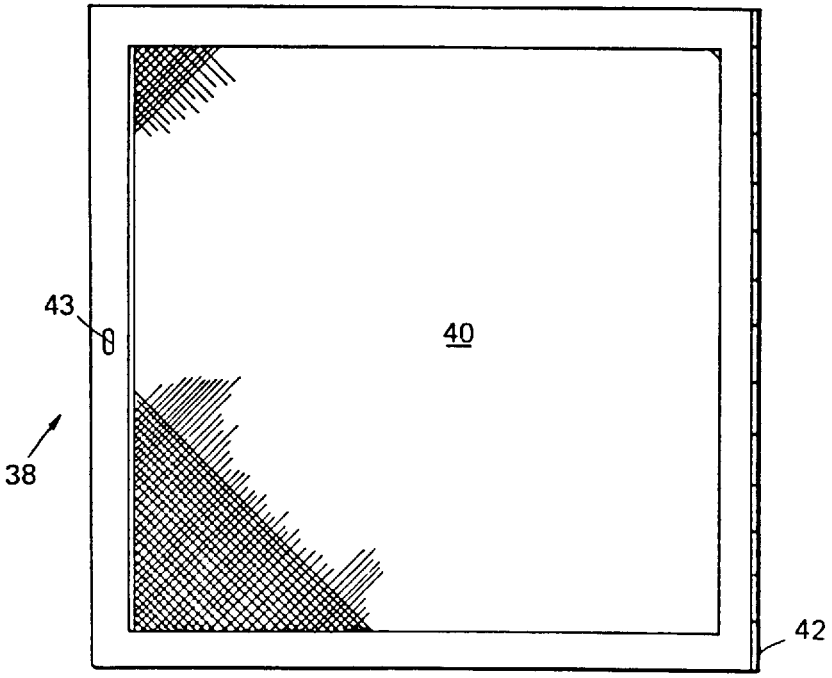

FIGS. 16 and 17 illustrate a filter unit 38 with a three speed electric fan 39 and air inlet 40 in the bottom provided by a framed mesh screen flap 41 hinged at 42 with catch 43. The lower hinged flap 41 supports the filter device 44 according to the invention. The top part of the housing in effect has a double wall arrangement in that air is drawn through the filter device 44 and passes through the central region to the fan 39 whereafter it flows outwardly and downwardly through a duct to the louvred outlets 45 provided on all sides. The unit 38 is mountable on ceiling 46.

It is to be appreciated that no means are provided in any of the housings for charging or ionizing particles in the air upstream of the potential means and filter medium and thus the apparatus of the invention does not operate in the manner of an ionizer or electrostatic filter nor in the manner of a precipitator. Furthermore, the filter medium is polarised rather than an electrostatic charge being applied thereto.

It is believed that the high voltage power source when connected to the conductive means in the form of a screen or mesh placed adjacent to, and in contact with, a non-conductive polarisable filter media, the effect upon said media is to shift the surface electrons of each strand of media to face the high voltage carrying means. In other words, if the high voltage applied is positive, all the negative electrons will move to the front of each strand or fibre of media and all the positive electrons will collect on the back side (see FIG. 18). It has been discovered through testing that once this electron shift occurs, the media is in fact polarized, resulting in an effect on airborne particles similar to the effect a magnet has on iron filings.

Figure 18:
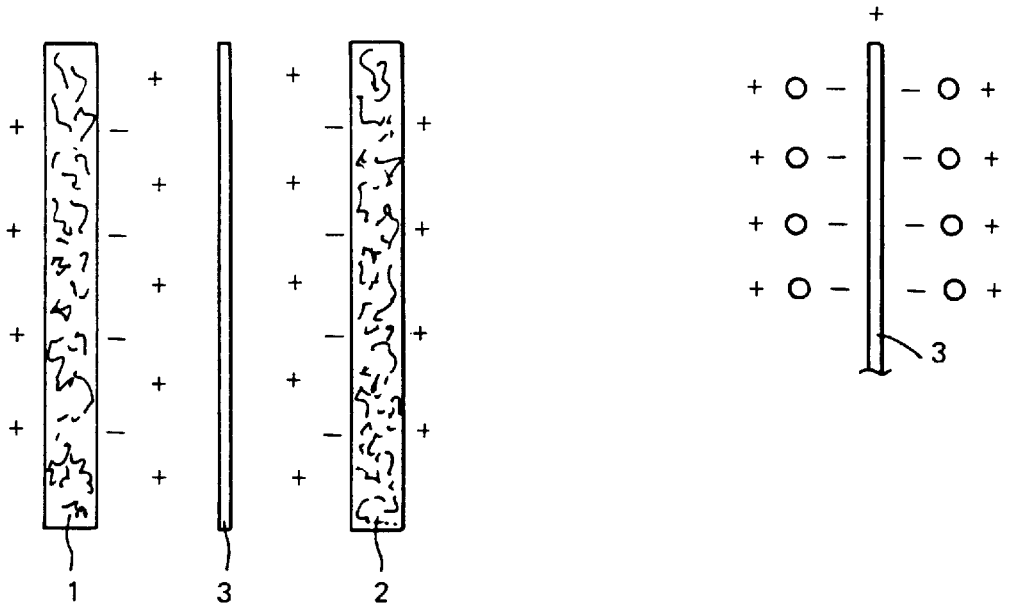
FIG. 18 illustrates electron shift in the filter device of the invention.

As far as the ionisation of particles through the filter is concerned, it has been found that by applying the high voltage in the centre of our collection media, an electron shift is created in the individual fibres of the media (see FIG. 18).

This being the case, a particle moving through these fibres cannot carry a charge as it will be subjected to both positive and negative field effects. If it is pulled onto a collector (strand of media) it will be held by the charge on the media, much as a metal filing is held on a magnet. As long as the charge is apparent the particle will not be released. If it is not held on passage it will not pick up a charge due to the fact that two dipoles, the particle and the collector, have no reason to transfer energy. Only on contact can the particle become ionized.

The normal operation of a filter media is to rely on the airborne particles impacting on their surfaces, to increase the efficiency of arrestance more fibers are added to form closer and denser weaves. As this is done, the resistance to air movement is greatly increased and ever larger fans are required to move the air through the media.

With the present invention, the airborne particles passing through a very open weave media, subjected to polarisation, will be pulled from the air stream and held by the power of the electrostatic force field effect and will not be easily removed by air flow.

I claim:

1. A filter device comprising a filter medium for gas with said medium being of polarisable dielectric material, a screen or mesh of electrically conductive material having a receptacle for connecting to a supply of high voltage power and to abut or be adjacent said filter medium and main, outermost support means of dielectric material for said screen or mesh and filter medium without any electrically conductive screen being interposed between the filter medium and said main outermost support means such that when said electrically conductive material is subject to a high voltage, the material of the filter medium is polarised, wherein nothing apart from air or a dielectric support means is on a side of the filter medium immediately opposite to the screen or mesh of electrically conductive material, and no charge applying means are located upstream of said screen or mesh.

2. A filter device as claimed in claim 1, in which the outer support means each have a peripheral frame forming a support or housing part for the composite arrangement.

3. A device as claimed in claim 2 in which a high voltage power supply or means for supplying a high voltage to said screen or mesh is mounted on the frames forming support means.

4. A filter device as claimed in claim 1, in which the filter medium comprises filter material of a non-woven random disposition mat.

5. A device as claimed in claim 4, in which the filter medium is glass fibers bonded with a material selected from the group comprising urea formaldehyde, polypropylene, polystyrene and nylon.

6. A device as claimed in claim 5 in which the filter medium is non-tackified.

7. A filter device as claimed in claim 1 in which automatic earthing or ground means are provided and operable such that upon separation of the components, the screen or mesh is grounded for safety purposes.

8. A device as claimed in claim 1 in which all components are detachable so that each can be removed from the other and be immersed in a cleaning solution for the purpose of cleaning.

9. A device as claimed in claim 1, in which the screen or mesh comprises a metal screen or mesh supported by a frame.

10. A device as claimed in as claimed in claim 1, in which the screen or mesh is electrically insulated from any of the electrically conductive components of a supporting housing.

11. A device as claimed claim 1 in which the high voltage supply to the screen or mesh is disconnected automatically when any outer support frame is removed.

12. A filter device comprising a filter medium for gas of dielectric material; a screen or mesh of electrically conductive material juxtaposed adjacent or against said filter medium and having a receptacle for connecting to a supply of high voltage power, and support or retention means for the filter medium, said support or retention means being comprised of dielectric material and wherein no electrically conductive screen is disposed between the filter medium and the support or retention means and wherein no ground return corresponding to the screen or mesh of electrically conductive material is on a side of said filter medium immediately opposite to said screen or mesh; said screen or mesh being such that when the high voltage power supply is connected the filter medium is caused to be polarised.

13. A filter device as claimed in claim 12, in which the screen or mesh is a screen of metal gauze or wire mesh or perforated metal sheet or grill of wires, and two filter media are provided each located on opposite sides of said screen or mesh and two dielectric retention or support means are provided located at distal opposite sides of the two filter media with said retention or support means comprising a mesh of electrically non-conductive material.

14. A filter apparatus including a filter housing having an inlet and an outlet and a filter device detachably locatable therebetween; said filter device comprising a filter medium for gas of dielectric and polarisable material, an electrically conductive screen or mesh forming a charge applying means having a receptacle for connecting to a supply of high voltage power and said screen or mesh and filter medium being supported by support means only of dielectric material such that when said screen or mesh is subject to a high voltage, the material of the filter medium is polarised; and either nothing apart from air or a support or retention means of dielectric material is on a side of said filter medium immediately opposite to said charge applying means, and no charge applying means are located upstream of said screen or mesh.

* * * * *